US006997686B2

(12) United States Patent
Agrawal et al.

(10) Patent No.: US 6,997,686 B2
(45) Date of Patent: Feb. 14, 2006

(54) MOTOR DRIVEN TWO-STAGE CENTRIFUGAL AIR-CONDITIONING COMPRESSOR

(75) Inventors: Giridhari L. Agrawal, Simsbury, CT (US); Niels A. Jorgensen, Simsbury, CT (US)

(73) Assignee: R & D Dynamics Corporation, Bloomfield, CT (US)

( * ) Notice: Subject to any disclaimer, the term of this patent is extended or adjusted under 35 U.S.C. 154(b) by 110 days.

(21) Appl. No.: 10/741,924

(22) Filed: Dec. 19, 2003

(65) Prior Publication Data

US 2004/0179947 A1 Sep. 16, 2004

Related U.S. Application Data

(60) Provisional application No. 60/434,837, filed on Dec. 19, 2002.

(51) Int. Cl.
*F04B 17/03* (2006.01)

(52) U.S. Cl. ..... 417/350; 417/44.1; 417/250; 417/365; 417/370; 417/423.8

(58) Field of Classification Search ..... 384/105, 384/107; 417/44.1, 247, 250, 350, 365, 370, 417/423.8, 423.12, 185
See application file for complete search history.

(56) References Cited

U.S. PATENT DOCUMENTS 3,022,739 A * 2/1962 Herrick et al. ..... 417/350
3,094,272 A * 6/1963 McClure ..... 417/350
3,296,824 A * 1/1967 Rohrs et al. ..... 417/350
4,167,295 A * 9/1979 Glaser ..... 384/105
4,402,618 A * 9/1983 Fortmann et al. ..... 384/107
4,523,896 A * 6/1985 Lhenry et al. ..... 417/350
5,857,348 A 1/1999 Conry
6,102,672 A 8/2000 Woollenweber et al.
6,155,802 A * 12/2000 Choi et al. ..... 417/350
6,302,661 B1 * 10/2001 Khanwilkar et al. ... 417/423.12
6,375,438 B1 4/2002 Seo
6,450,781 B1 9/2002 Petrovich et al.
6,471,493 B1 * 10/2002 Choi et al. ..... 417/350
6,498,410 B1 12/2002 Yashiro et al.
6,499,955 B1 * 12/2002 Choi et al. ..... 416/185
6,579,078 B1 6/2003 Hill et al.

(Continued)

OTHER PUBLICATIONS

Agrawal, Giri L., "Foil Air/Gas Bearing Technology—An Overview", Int'l. Gas Turbine & Aeroengine Congress & Exhibition, Jun. 1997, pp. 1-11, ASME, New York, NY, US.

*Primary Examiner*—Michael Koczo, Jr.
(74) *Attorney, Agent, or Firm*—McCormick, Paulding & Huber LLP

(57) ABSTRACT

A two-stage compressor for generating necessary pressure differential for air-conditioning applications with air-cooled, water-cooled and evaporative-cooled condensing systems using low-pressure refrigerant, such as R134a, is provided. A rotating assembly is mounted for rotation in a compressor housing and includes a shaft, a thrust bearing disk associated with the shaft to maintain an axial position of the rotating assembly, a motor rotor mounted on the shaft, and first and second impellers mounted for rotation with the shaft. First and second journal bearings are mounted in the compressor housing to support the shaft and maintain radial positioning of the rotating assembly. Volute housings including a spiral-shaped volute are associated with each of the impellers to collect and further discharge gas compressed by the impellers. Diffusers having air-foil shaped vanes are locate in the volute channels adjacent the discharge outlets of the impellers to aide in the discharge of gas from the impellers.

20 Claims, 7 Drawing Sheets

U.S. PATENT DOCUMENTS 6,634,853 B1 10/2003 Anderson 6,698,929 B1 * 3/2004 Choi et al. ..... 417/247

* cited by examiner

MOTOR DRIVEN TWO-STAGE CENTRIFUGAL AIR-CONDITIONING COMPRESSOR

CROSS-REFERENCE TO RELATED APPLICATION

This application claims the benefit of U.S. Provisional Application 60/434,837, filed Dec. 19, 2002, which is incorporated herein by reference.

FIELD OF THE INVENTION

Air conditioning systems used in homes and commercial buildings consume 36 percent of annually generated primary energy. To reduce energy consumption, high efficiency compressors are required. Commonly, these compressors are motor driven, and compress refrigerant gas into high pressure refrigerant vapor. The present invention relates to conception, design and manufacture of compressors, and more particularly to motor driven compressors in the size ranging from 25 kW to 200 kW. The present invention also relates to associated technologies for compressors, including their integration into packaged air conditioning systems applying air-cooled, water-cooled or evaporative-cooled condensers.

BACKGROUND OF THE INVENTION

Historically, compressing refrigerant gas in the compressor size range below 200 kW has been carried out by motor driven positive displacement machines—e.g., piston, vane, screw. Centrifugal compressors currently used are very large, as they must rotate at moderate rotational speeds with high compressor rotor tip speeds in order to be efficient. While such centrifugal compressor can offer efficient operation, they should not be operated at high rotational speeds. High rotation speeds, however, are desirable because the compressors, and therefore the technology with which the compressors are integrated, can be made smaller while still maintaining the same compressed gas flows and pressures and overall efficiency of operation. Requirements for running at high speeds include properly designed machines running at 20,000 to 75,000 rpm.

High-speed rotating machines supported on foil air bearings have made significant progress in the last thirty years. Reliability of high-speed rotating machines with foil bearings has shown a tenfold improvement compared to designs using rolling element bearings.

The use of foil air bearings in centrifugal compressors for refrigeration applications has several advantages:

Oil Free Operation: Typical gas compressors use oil as a lubricant for the compressor bearing. With foil air bearings, there is no miscibility problem between refrigerant and oil requiring oil management, no chemical reaction between oil and refrigerant, no degradation of heat transfer surfaces in the evaporator coils, and no oil running through the components of the compressor.

Higher Reliability: Foil gas bearing machines are more reliable because fewer parts are necessary and no lubrication feeding system is required. In operation, the gas film between the bearing and the motor driven shaft protects the bearing foil from wear. The bearing surface and the shaft are only in contact at start and stop of the machine. In these brief moments, special coating protects the foil against wear.

No Scheduled Maintenance: Since a foil gas bearing machine does not require oil lubricant there is no need for monitoring and replacing the oil.

Environmental and System Durability: Foil gas bearings can handle severe environmental conditions such as shock and vibration loading. Any liquid from the system can also be easily handled without detrimental effect on the bearings.

High Speed Operation: Compressor rotors have better aerodynamic efficiency at higher speeds. Foil gas bearings allow such machines to operate at higher rotational speeds without any limitations as opposed to ball bearings. Due to the hydrodynamic action, foil gas bearings also have higher load capacity as speed increases.

Low and High Temperature Capabilities: Oil lubricants cannot operate at very high temperatures without breaking down. At low temperatures oil lubricants become too viscous to function effectively. Foil air bearings, by comparison, operate efficiently both at severely high temperatures and at cryogenic temperatures.

Incorporation of foil gas bearings into motor driven rotating machines, such as compressors, has been difficult because of additional technologies that are required for efficient operation. For example, the foil bearings must have higher spring rate to compensate for negative spring rate for the motor rotor. Further, sufficient cooling flow between rotor shaft and motor stator is needed to remove heat generated by the motor. An effective cooling scheme is also required for the motor stator. Further, a high-frequency controller is required to drive the motor and maintain the desired operational speeds.

SUMMARY OF THE INVENTION

According to one aspect of the present invention, a compressor assembly is provided for compressing gas, comprising a compressor housing having a gas inlet for receiving gas to be compressed and a gas outlet for the compressed gas, and a rotating assembly mounted for rotation about an axis within the compressor housing. The rotating assembly includes a shaft being supported for rotation within the compressor housing, a thrust bearing disk for maintaining an axial position of the rotating assembly along its axis within the compressor housing, a motor rotor mounted on the shaft, and first and second impellers mounted for rotation on the shaft at opposite ends of the shaft, each impeller having an inlet, a discharge outlet, and an integral shroud cover cooperating with multiple blades to define passages for gas passing through the impeller between the inlet and the outlet. First and second volute housings, each including a spiral-shaped volute, are connected with the compressor housing and are respectively associated with the discharge outlets of the first and second impellers for collecting gas discharged thereby and further discharging the gas. A diffuser having air-foil shaped vanes is located in each volute adjacent the discharge outlet of the respective impeller with which the volute is associated.

According to the first aspect of the present invention a motor stator is supported by the compressor housing and cooperates with the motor rotor for driving the rotating assembly. Further, first and second journal bearings are mounted in the housing for supporting the shaft for rotation and for maintaining a radial position of the rotating assembly with respect to its axis within the compressor housing.

According to a preferred aspect of the present invention, a two-stage compressor is provided having a transition pipe for conveying discharged gas from the first compressor stage to the second compressor stage for further compression. The first compressor stage includes a first impeller that receives gas from the compressor inlet and discharges gas to a first diffuser and a first volute. The second compressor stage includes a second impeller that discharges gas to a second diffuser and a second volute and ultimately out the compressor outlet. Preferably, the stages are located on opposite sides of the motor.

The present invention preferably is directed to a compact, high-efficiency, oil-free, motor-driven, two-stage centrifugal compressor suitable for generating necessary pressure differential for air-conditioning application with air-cooled, water-cooled and evaporative-cooled condensing systems using environmentally safe low pressure refrigerant, such as R134a. Aspects of embodiments of the invention may further include:

1. Rotating assembly supported by two high spring-rate foil gas journal bearings;

2. Axial load is borne by two high spring-rate, high load-capacity foil gas thrust bearings;

3. Two shrouded impellers designed with optimum flow coefficient and thrusting in opposite axial directions;

4. Two-piece spiral volute housings having rectangular cross-section for economical manufacture and integrated with an axial inlet port;

5. Diffusers with low solidity air-foil shaped vanes or blades which allow operation at low flow without surging;

6. High-speed induction, permanent magnet or switched reluctance motor located between the compressor stages and impellers, with a rotor mounted on a common shaft and a stator supported by the compressor housing;

7. Internal cooling of the motor rotor by means of refrigerant gas flow propelled by pressure differential between high stage and low stage and bled through journal bearings;

8. Cooling of the motor stator by means of flashing liquid refrigerant through a cooling jacket having a corkscrew shaped groove or channel;

9. External duct for funneling first stage discharge to the second stage inlet;

10, Control of motor speed by step-less modulation of the motor speed by means of a variable frequency drive;

11. Control of capacity output by means of hot gas bypass valve in response to load demand from the air-conditioning system; and 12. Vapor port at second stage to provide economizer action for enhanced refrigeration capacity and compressor energy efficiency.

DETAILED DESCRIPTION OF THE INVENTION AND PREFERRED EMBODIMENTS THEREOF

Figure 1:
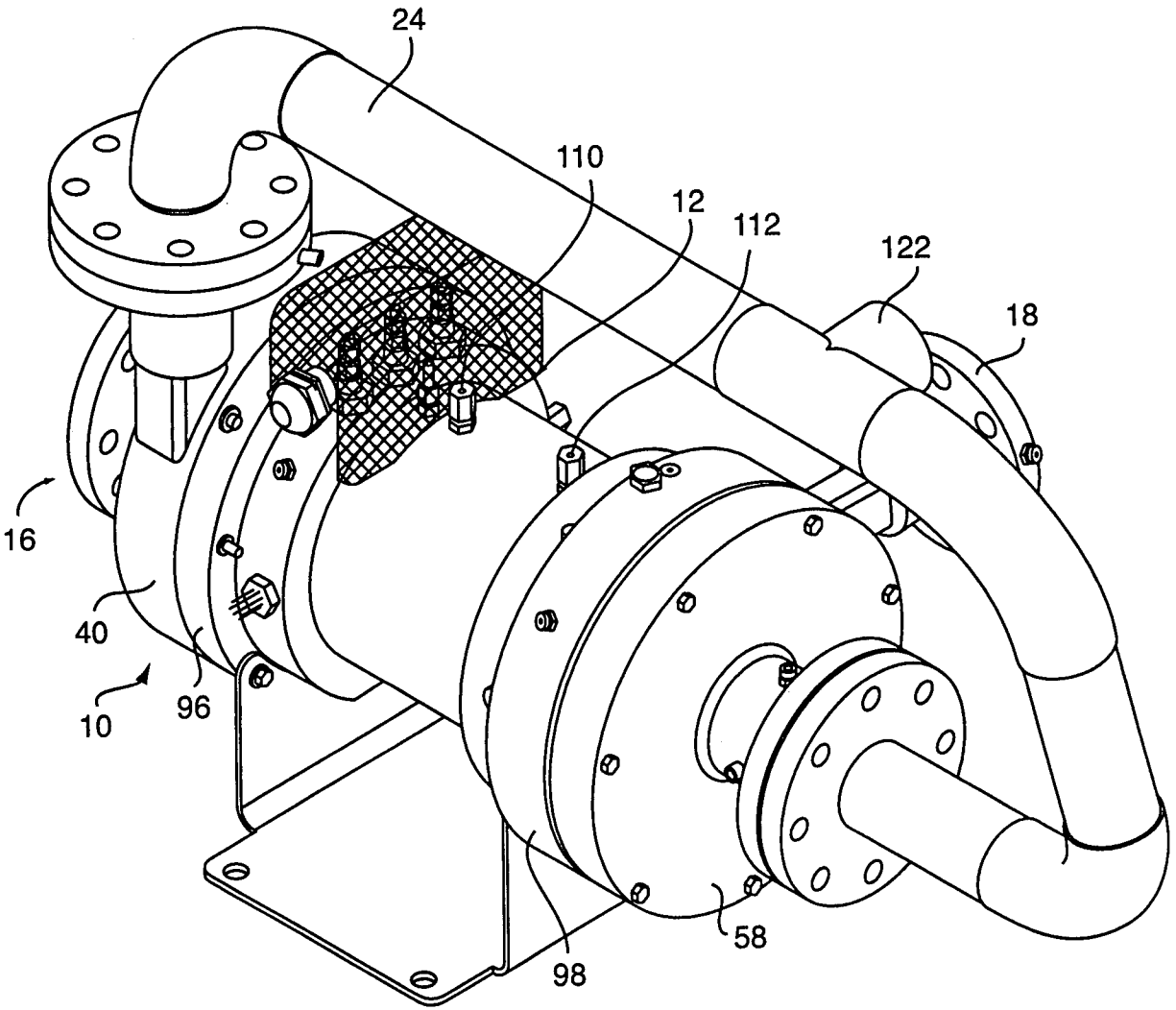
FIG. 1 is a perspective view of an embodiment of a two-stage compressor in accordance with the present invention.
Figure 2:
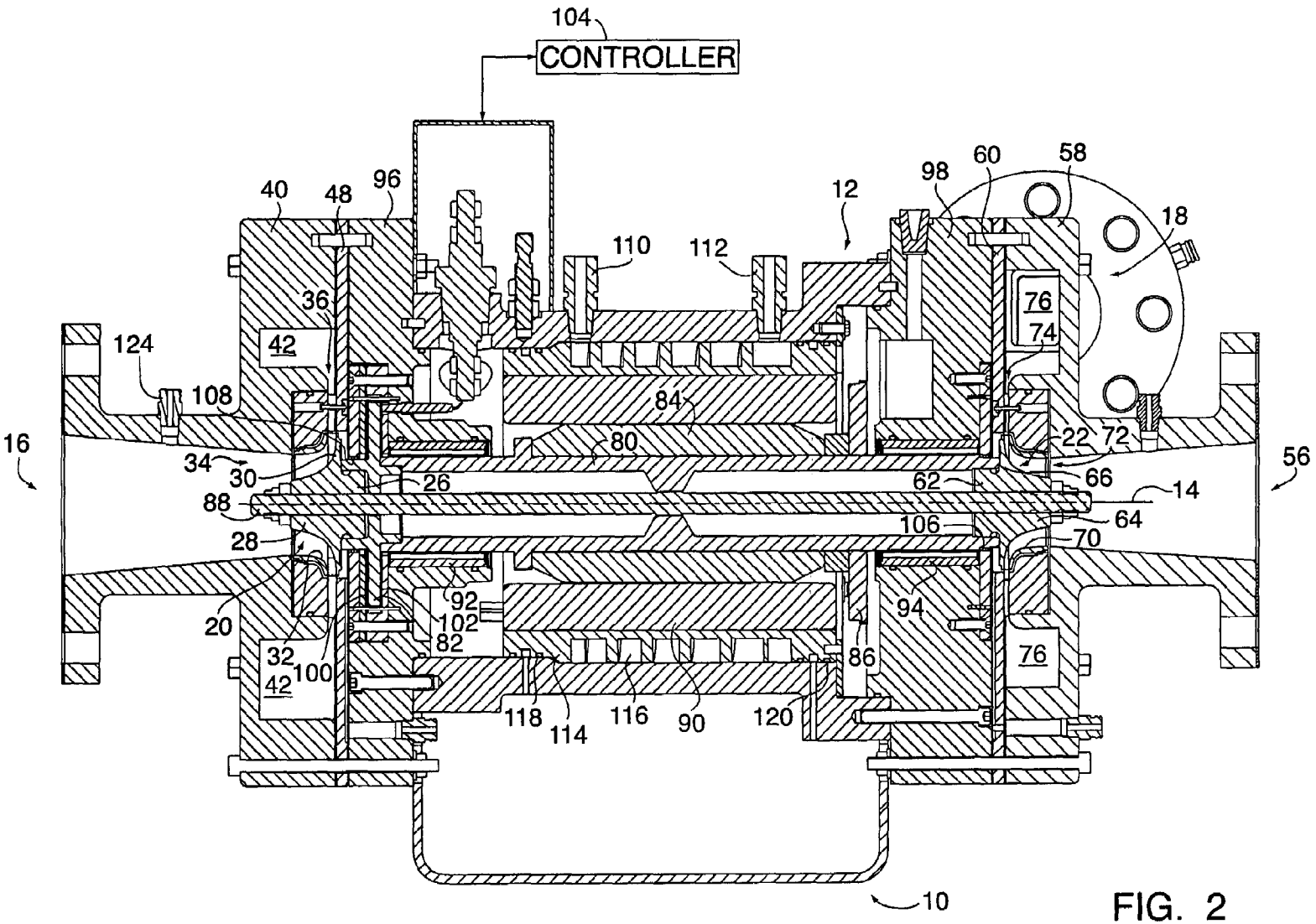
FIG. 2 is a sectional view of the two-stage compressor shown in FIG. 1.

An external perspective view and cross-section view of a motor driven compressor 10 in accordance with the present invention are shown in FIGS. 1 and 2, respectively. The compressor 10 has a compressor housing 12 which is generally symmetric about a central axis 14. At one end of the housing 12 is an inlet 16 for the refrigerant gas to be compressed, and a discharge outlet 18 for the compressed gas. The compressor 10 shown in FIGS. 1 and 2 is a two-stage centrifugal compressor comprising a first impeller 20 and a second impeller 22 connected in series by a transition pipe 24. The present invention, however, is not limited in this respect, and may be adapted to impellers situated within the compressor in parallel.

Figure 4:
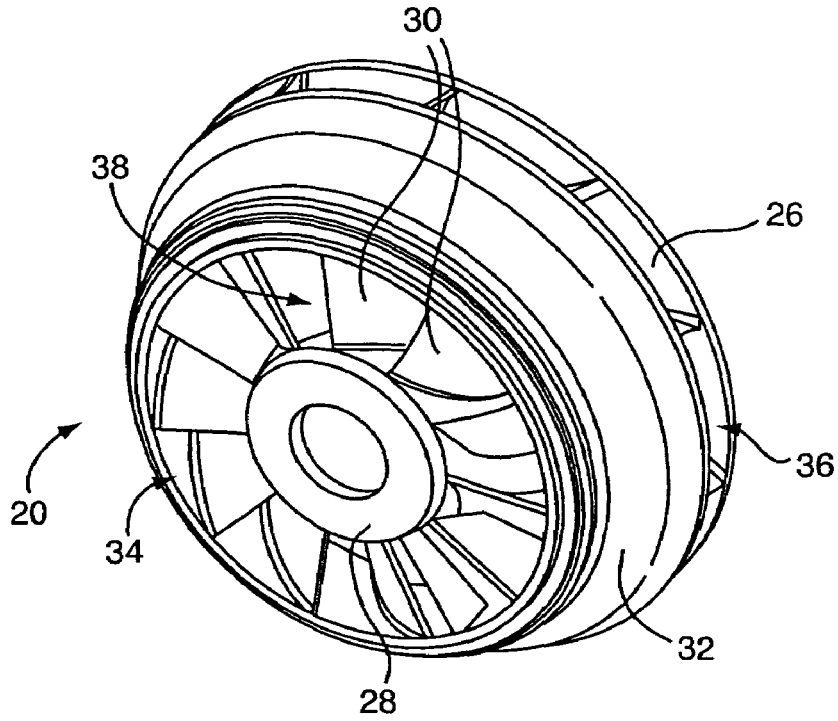
FIG. 4 is a perspective view of a shrouded impeller incorporated in an embodiment of the present invention.
Figure 5:
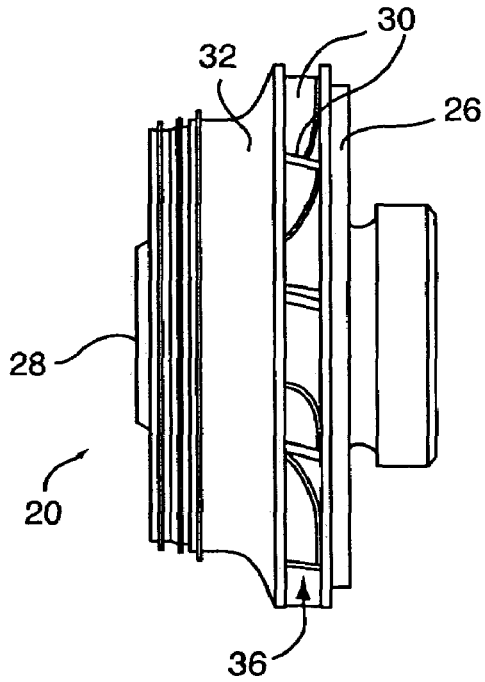
FIG. 5 is a side view of the shrouded impeller of FIG. 4.

The inlet 16 leads to the first compressor stage which includes the first impeller 20. The first impeller 20 is preferably designed for optimum flow coefficient. As shown more particularly in FIGS. 4 and 5, the first impeller 20 comprises an impeller base 26, an impeller hub 28, multiple blades or vanes 30, and a shroud cover 32 provided over the blades 30. The shroud cover 32 more preferably is integral with the impeller and defines an impeller inlet 34 in combination with the impeller hub 28, and an impeller discharge outlet 36 in combination with the impeller base 26. The shroud cover 32 also cooperates with the blades 30 to define passages for gas passing through the impeller between the impeller inlet 34 and the impeller discharge outlet 36. The blades 30 are preferably three-dimensional, S-shaped blades connected to the impeller base 26 and the impeller hub 28, with full inducer portions 38 at the impeller inlet 34 serving to guide the in-flow of gas more evenly through the impeller in order to limit curvature losses.

As shown in FIG. 2, a first volute housing 40 surrounds the first impeller 20 and the inlet 16. The first volute housing 40 includes a volute channel 42 in which gas discharged by the first impeller 20 through the impeller discharge outlet 36 is collected.

Figure 7:
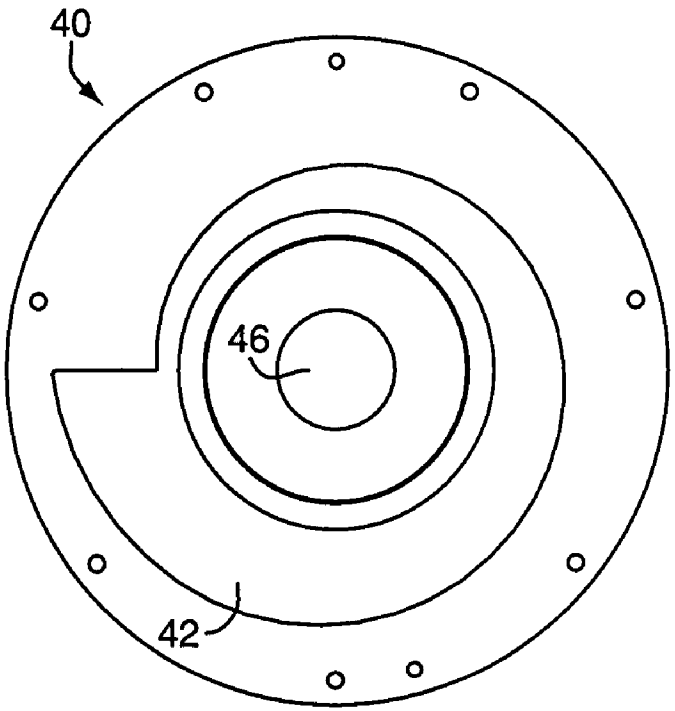
FIG. 7 is a side view of the volute housing shown in FIG. 6.
Figure 6:
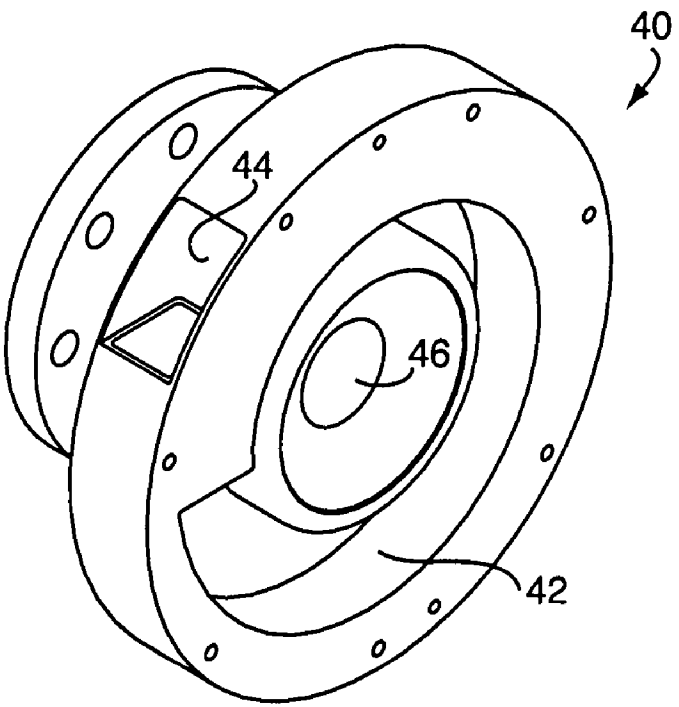
FIG. 6 is a perspective view of a volute housing incorporated in an embodiment of the present invention.

The first volute housing 40 is shown more particularly in FIGS. 6 and 7. As shown, the volute channel 42 preferably comprises a logarithmic, spiral-shaped channel in which the gas discharged from the impeller 20 is collected. The gas eventually is discharged out of a volute outlet 44. Though shown in FIG. 6 as having a generally square or rectangular cross-section, the volute frame may have any cross-sectional shape. Such square or rectangular cross-section is economical to manufacture. The volute housing 40 is also preferably integrated with the axial inlet port of the compressor stage with which it is associated. In FIG. 6, for example, a first volute inlet port 46 is associated with the axial inlet 16 of the compressor 10.

Figure 9:
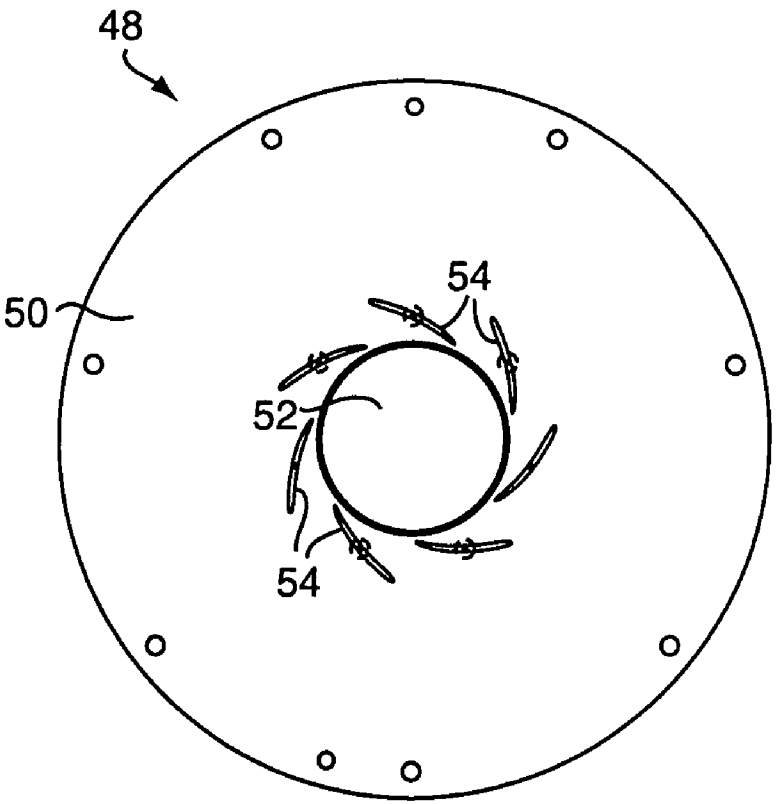
FIG. 9 is side view of the diffuser shown in FIG. 8.
Figure 8:
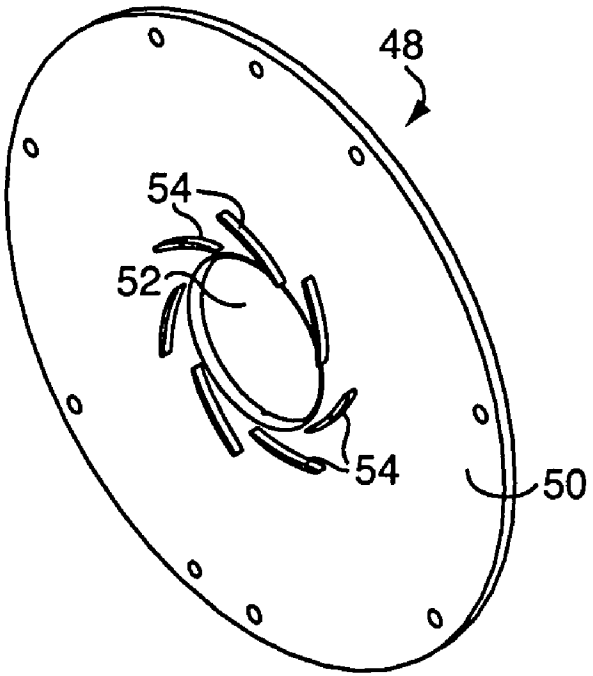
FIG. 8 is a perspective view of a diffuser incorporated in an embodiment of the present invention.

A first diffuser 48 is preferably located in the volute channel 42 adjacent the impeller discharge outlet 36. The first diffuser 48 is shown more particularly in FIGS. 8 and 9. As shown, the first diffuser 48 includes a diffuser plate 50 having an opening 52 for mounting the diffuser 48 within the compressor 10 around the shaft, discussed below. Multiple diffusing vanes or blades 54 are positioned around the opening 52. Preferably, the vanes or blades 54 are cambered, air-foil shaped, and have low solidity, which permits operation at low flow without surging. In operation, the vanes or blades 52 are positioned about and cooperate with the impeller discharge outlet 36 to direct gas into the first volute channel 42.

As shown in FIG. 1, the volute channel 42 is preferably axially overhung away from the diffuser plate 50. That is, the gas is discharged from the impeller 20 along the diffuser plate 50 and cycles through the volute channel 42 to one axial side towards the volute outlet 44.

The first volute outlet 44 directs the gas to the transition pipe 24 for conveying gas from the first compressor stage to the second compressor stage. As shown in FIG. 1, the transition pipe 24 directs the gas to an axial inlet port 56 of the second stage. The second stage, similar to the first stage, includes the second impeller 22, a second volute housing 58, and a second diffuser 60. The design of the components of the second stage is similar to those of the first stage. That is, the second impeller 22 also preferably has the structure shown in FIGS. 4 and 5, including an impeller base 62, and impeller hub 64, three-dimensional blades 66 with full inducer portions 68, and a shroud cover 70. The shroud cover 70 combines with the impeller hub 64 to define an impeller inlet 72 aligned with the axial inlet port 56 of the second stage. The shroud cover 70 also combines with the impeller base 62 to define an impeller discharge outlet 74 which cooperates with the second diffuser 58 to direct discharged gas into a volute channel 76 in the second volute housing 58. The shroud cover 70 also cooperates with the impeller blades 66 to define passages for gas passing through the second impeller 22 between the impeller inlet 72 and the impeller discharge outlet 74. The discharged gas collects in the second volute channel 76 and is further discharged through a second volute outlet (not shown) communicating with the outlet 18 of the compressor 10. The second volute housing 58 generally has the structure and components shown in FIGS. 6 and 7. Likewise, the second diffuser 60 generally has the structure and components shown in FIGS. 8 and 9.

Figure 3:
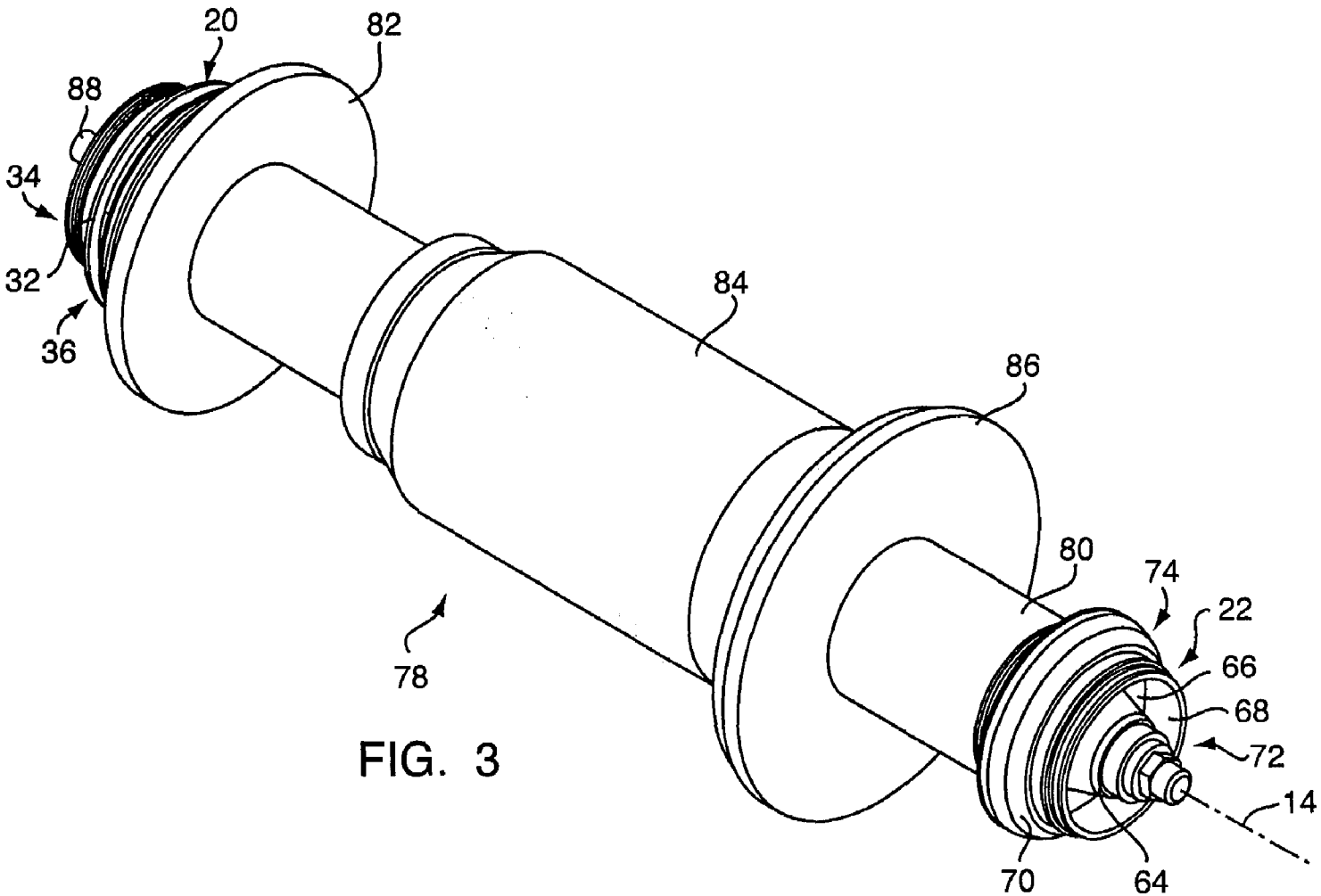
FIG. 3 is a perspective picture of an embodiment of a rotating assembly incorporated in the two-stage compressor shown in FIG. 1.

The compressor 10 also includes a rotating assembly, generally designated as reference numeral 78. As shown in FIGS. 2 and 3, the rotating assembly 78 includes the first and second impellers 20 and 22, respectively, a shaft 80, a thrust bearing disk 82, an induction motor rotor 84, and an encoder disk 86. A tie rod 88 clamps the elements of the rotating assembly 78 together and holds them under a pre-load to counteract any centrifugal loading while the compressor 10 operates at high speeds. The rotating assembly 78 will preferably be driven by an induction motor about the axis 14 in the range from 20,000 to 50,000 rpm. The first and second impellers 20 and 22, respectively, are preferably designed with optimum flow coefficient and to generate thrust in opposite axial direction, which reduces the total axial thrust on the rotating assembly 78.

The motor is preferably an electrically driven, high-speed induction, permanent magnet or switched reluctance motor and is shown in the FIGS. as including the motor rotor 84 and a motor stator 90 supported by the compressor housing 12. The motor rotor 84 fitted on the shaft 80, and acts as an armature of the motor to drive the rotating assembly 78. As shown in FIGS. 2 and 3, the motor rotor 84 is centrally mounted between the first and second stages, and therefore, between the first impeller 20 and the second impeller 22. Though the present invention is shown with the motor rotor 84 being centrally balanced, the present invention may also position two stages at one end thereof. The motor stator 90 is supported by the compressor housing 12 around the motor rotor 84 so as to cooperate therewith.

The shaft 80 is preferably a combined, single-piece drive shaft mounted for rotation on one end by a first journal bearing 92 and on an opposite end by a second journal bearing 94. The first and second journal bearings 92 and 94 are respectively installed in bearing housings 96 and 98 mounted on opposing ends of the compressor housing 12. Though shown in FIG. 2 as separate components, the bearing housings 96 and 98 may be integral with the compressor housing 12. The first and second journal bearings 92 and 94 support the rotating assembly 78 for rotation within the compressor housing 12 and further establish and maintain the radial position of the rotating assembly 78 with respect to the central axis 14. Preferably, the first and second journal bearings 92 and 94 are oil-less foil gas bearings, and more preferably, high spring-rate, foil gas journal bearings.

The thrust bearing disk 82 is flanked on opposing axial sides by a first and second thrust bearing 100 and 102, respectively. The thrust bearings 100 and 102 cooperate with the thrust bearing disk 82 to establish and maintain an axial position of the rotating assembly 78 with respect to the compressor housing 12. Preferably, the first and second thrust bearings 100 and 102 are oil-less foil gas bearings, and more preferably, high spring-rate, high load capacity foil gas thrust bearings. Foil gas bearings have numerous performance, maintenance and operating advantages over conventional roller or ball bearings as discussed in the Background Section above.

The encoder disk 86 is generally adapted sense the rotational speed of the rotating assembly 78 and communicates with a variable frequency drive (not shown) to control the operation of the rotating assembly 78. A drive controller and associated control circuitry, which are generally known in the art and are generically designated as reference numeral 104 in FIG. 2, communicate with both the encoder disk 86 and the induction motor to control the rotational speed of the rotating assembly 78 based on data sensed by the encoder disk 86. Control of the induction motor is preferably by step-less modulation of the motor speed by the variable frequency drive.

In operation, gas (e.g., environmentally safe, low-pressure refrigerant gas, such as R134a) enters the inlet 16 and passes to the first stage of the compressor 10. In a two-stage compressor system, after the gas is discharged from the first stage, it passes to the second stage, and ultimately is discharged out the outlet 18 at the desired pressure differential. That is, the gas enters the first impeller 20, is discharged at higher pressure through the first diffuser 48 and the first volute channel 42, and is led through the transition pipe 24 to the axial inlet port 56 of the second stage. The gas enters the second impeller 22, which compresses the gas to even higher pressure and discharges the gas through the second diffuser 60 and the second volute channel 76 out the discharge outlet 18.

During the above described operation, calibrated amount of gas may flow from the second impeller 22 past a labyrinth seal 106 and through the components of the rotating assembly 78 and the compressor 10 to internally cool those components. More specifically, the gas may flow from the second impeller 22 through the second journal bearing 94, then through the spacing between motor rotor 84 and the motor stator 90, then through the first journal bearing 92, then past the first and second thrust bearings 100 and 102 and the thrust bearing disk 82, then through another labyrinth seal 108 so it may empty out into the discharged gas from the first impeller 20. The gas flowing through this "leakage" path serves to remove heat from the motor rotor 84, the journal bearings 92 and 94, and the thrust bearings 100 and 102. The gas may be internally propelled through the compressor 10 by the pressure differential between the first and second stages.

Figure 11:
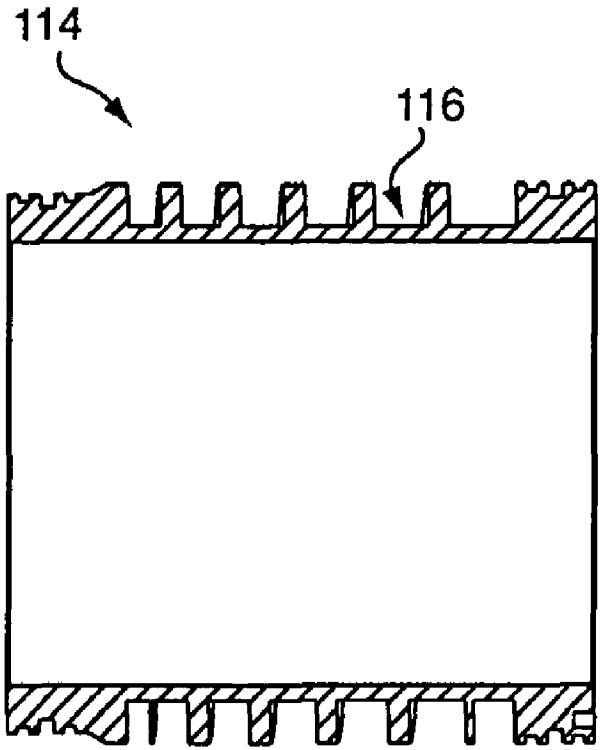
FIG. 11 is cross section of cooling jacket shown in FIG. 10.
Figure 10:
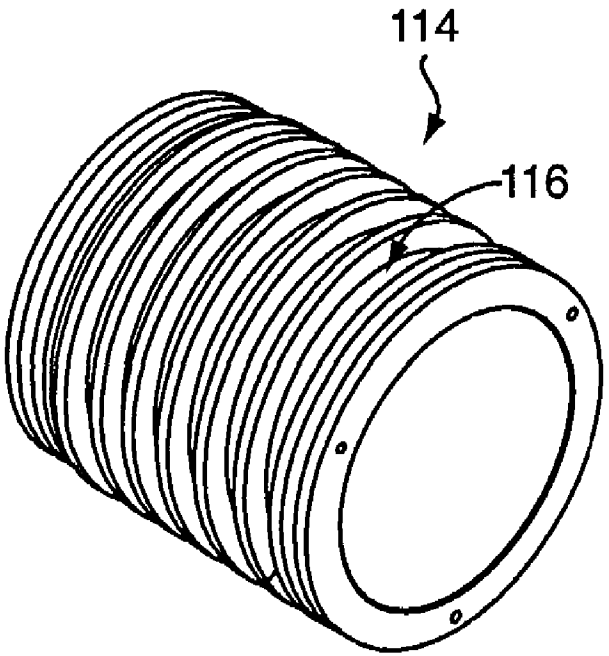
FIG. 10 is perspective view of a cooling jacket having a corkscrew-shaped channel incorporated in an embodiment of the present invention.

The compressor housing 12 also includes a cooling inlet 110 and cooling outlet 112, as shown in FIGS. 1 and 2, for circulating liquid refrigerant through the compressor 10. An inner cooling jacket 114 is mounted around the motor stator 90 and defines a cooling path in combination with the inner surface of the compressor housing 12. A preferable design of the cooling jacket 114 is shown in FIGS. 10 and 11. As shown, a corkscrew-shaped groove or channel 116 begins at one point on the circumference of the cooling jacket 114 located adjacent to the cooling inlet 110 and terminates at another point of the cooling jacket 114 near the cooling outlet 112. O-rings 118 and 120 seal the cooling jacket 114 within the compressor housing 12. During operation, liquid refrigerant is be piped to the cooling inlet 110 and is flashed, thereby removing heat from the motor stator 90 as the refrigerant passes through the corkscrew-shaped groove 116 and exits at the cooling outlet 112. The cooling refrigerant may be bled from a system condenser.

The present invention may further include an external vapor port 122 located on the transition pipe 24 to allow injection of refrigerant vapor from an air-conditioning system with which the compressor 10 is associated to provide economizer action and increases capacity and efficiency of the refrigerant cycle. In operation, for example, medium pressure refrigerant vapor may be funneled into the second stage for enhanced refrigeration capacity and compressor energy efficiency.

The present invention may further include a mass flow sensor, indicated generally as reference numeral 124 in FIG. 2, inserted into the inlet 16 for monitoring compressor capacity. The sensor 124 may communicate with the controller 104 for adjusting operation of the compressor 10 and or the rotating assembly 78 based on information sensed by the sensor 124. Additional sensors may be positioned throughout the compressor 10 to monitor operation thereof. Further, valves may be provided throughout the system to control operating capacity output based on information sensed by the system sensors or in response to load demand from the air conditioning system in which the compressor 10 is installed.

The foregoing description of embodiments of the present invention has been presented for the purpose of illustration and description, and is not intended to be exhaustive or to limit the present invention to the form disclosed. As will be recognized by those skilled in the pertinent art to which the present invention pertains, numerous changes and modifications may be made to the above-described embodiments without departing from the broader aspects of the present invention.

What is claimed is:

1. A compressor assembly for compressing gas, comprising:

a compressor housing having a gas inlet for receiving gas to be compressed and a gas outlet for the compressed gas;

a rotating assembly mounted for rotation about an axis within the compressor housing including:

a shaft being supported for rotation within the compressor housing;

a thrust bearing disk for maintaining an axial position of the rotating assembly along its axis within the compressor housing;

a motor rotor mounted on the shaft; and first and second impellers mounted for rotation with the shaft at opposite ends of the shaft, each impeller having an inlet, a discharge outlet and an integral shroud cover cooperating with impeller blades to define passages for gas passing through the impellers between the inlet and the outlet;

a motor stator supported by the compressor housing and cooperating with the motor rotor for driving the rotating assembly;

first and second journal bearings mounted in the compressor housing for supporting the shaft for rotation and for maintaining a radial position of the rotating assembly with respect to its axis within the compressor housing;

first and second volute housings connected with the compressor housing and respectively associated with the discharge outlets of the first and second impellers for collecting gas discharged thereby and further discharging the gas, each said volute housing defining a logarithmic spiral-shaped volute in which discharged gas is received from the associated impeller; and first and second diffusers associated with the first and second volute housings, respectively, each diffuser having air-foil shaped vanes located in the volute adjacent the discharge outlet of the respective impeller with which the respective volute housing is associated.

2. The compressor assembly of claim 1, further comprising a tie rod for holding the first impeller, the thrust bearing disk, the shaft and the second impeller under preload.

3. The compressor assembly of claim 1, wherein the first impeller and the second impeller are oriented to generate thrust in opposing axial directions.

4. The compressor assembly of claim 1, further comprising a transition pipe for conveying discharged gas from the first volute housing to the second impeller inlet.

5. The compressor assembly of claim 4, further comprising an injection vapor port communicating with the transition pipe for funneling vapor into the second impeller.

6. The compressor assembly of claim 1, the first and second journal bearings being oil-less foil gas bearings.

7. The compressor assembly of claim 1, further comprising first and second thrust bearings mounted in a bearing housing connected to the compressor housing, the first and second thrust bearings cooperating with the thrust bearing disk to maintain an axial position of the rotating assembly along its axis within the compressor housing.

8. The compressor assembly of claim 7, the first and second thrust bearings being oil-less foil gas thrust bearing.

9. The compressor assembly of claim 1, the compressor housing further comprising:

a cooling inlet;

a cooling outlet; and a cooling jacket surrounding the motor stator and defining a cooling path for circulating coolant between the cooling inlet and the cooling outlet.

10. The compressor assembly of claim 9, the cooling jacket further including a corkscrew-shaped groove for circulating the coolant.

11. The compressor assembly of claim 1, further comprising a leakage path for gas passing through the compressor assembly, said path flowing from the second impeller discharge outlet, through the second journal bearing, through a gap defined between the motor rotor and the motor stator, through the first journal bearing, through the thrust bearing disk, and out the first impeller discharge outlet.

12. The compressor assembly of claim 1, the rotating assembly further comprising an encoder disk mounted on the shaft for sensing the rotational speed of the rotating assembly.

13. The compressor assembly of claim 12, further comprising a drive controller communicating with the encoder disk and the motor rotor for controlling rotational speed of the rotating assembly.

14. The compressor assembly of claim 1, further comprising a mass flow sensor positioned along the gas inlet of the compressor housing for monitoring compressor capacity.

15. The compressor assembly of claim 1, each impeller including a plurality of three-dimensional impeller blades having full inducers at the impeller inlet.

16. The compressor assembly of claim 15, each volute being axially overhung away from the respective diffuser with which it is associated.

17. A two-stage compressor assembly for compressing gas, comprising:

a compressor housing having a gas inlet for receiving gas to be compressed and a gas outlet for the compressed gas;

a rotatable shaft supported for rotation in the compressor housing by first and second journal bearings, the first and second journal bearings maintain a radial position of the rotatable shaft within the compressor housing;

a first compressor stage including:

a first impeller mounted on the rotatable shaft adjacent one end thereof and receiving gas from the compressor gas inlet through a first impeller axial inlet port and discharging gas through a first impeller discharge outlet;

a first volute in which discharged gas is collected from the first impeller and further discharged; and a first diffuser having air-foil shaped vanes located in the first volute adjacent the first impeller discharge outlet;

a second compressor stage including:

a second impeller mounted on the rotatable shaft adjacent the other end thereof and receiving gas through a second impeller axial inlet port and discharging gas through a second impeller discharge outlet;

a second volute in which discharged gas is collected from the second impeller and further discharged through the compressor gas outlet;

a second diffuser having air-foil shaped vanes located in the second volute adjacent the second impeller discharge outlet;

a transition pipe for conveying discharged gas from the first compressor stage to the second compressor stage;

a motor for driving the shaft, the motor including a rotor mounted on the rotatable shaft between the first and second impellers and a stator supported by the compressor housing and cooperating with the rotor; and a thrust bearing disk and first and second thrust bearings mounted on either side of the disk for maintaining an axial position of the rotatable shaft within the compressor housing.

18. The two-stage compressor assembly of claim 17, wherein the first impeller and the second impeller are oriented to generate thrust in opposing axial directions.

19. The two-stage compressor assembly of claim 17, further comprising an injection vapor port communicating with the transition pipe for funneling vapor into the second impeller.

20. The compressor assembly of claim 17, further comprising a mass flow sensor positioned along the gas inlet of the compressor housing for monitoring compressor capacity.

* * * * *

UNITED STATES PATENT AND TRADEMARK OFFICE

CERTIFICATE OF CORRECTION

PATENT NO. : 6,997,686 B2
APPLICATION NO. : 10/741924
DATED : February 14, 2006
INVENTOR(S) : Giridhari L. Agrawal et al.

It is certified that error appears in the above-identified patent and that said Letters Patent is hereby corrected as shown below:

Column 5, line 3, please delete the number "52" and replace it with --54--.
Column 5, line 6, please delete the number "1" and replace it with --2--.

Signed and Sealed this

Twenty-second Day of August, 2006

JON W. DUDAS
*Director of the United States Patent and Trademark Office*